United States Patent [19]

Mattson

[11] 4,236,331

[45] Dec. 2, 1980

[54] MAGNETIC BADGE ASSEMBLY

[76] Inventor: Ralph W. Mattson, 511 Walnut St., Batavia, Ill. 60510

[21] Appl. No.: 963,448

[22] Filed: Nov. 24, 1978

[51] Int. Cl.[3] ..... A44C 3/00

[52] U.S. Cl. ..... 40/1.5; 40/600; 40/621

[58] Field of Search ..... 40/1.5, 2.2, 600, 621; 24/201 B; 63/29 M

[56] References Cited

U.S. PATENT DOCUMENTS

| | | | |
|---|---|---|---|
| 1,824,161 | 9/1931 | Lethert | 40/1.5 |
| 2,177,406 | 10/1939 | Hacker | 40/1.5 |
| 2,557,399 | 6/1951 | Teetor | 40/10 R |
| 2,615,227 | 10/1952 | Hornik | 63/29 MX |
| 2,639,654 | 11/1954 | Clark | 40/1.5 |
| 3,566,521 | 3/1971 | Conner | 40/2.2 |
| 3,902,262 | 9/1975 | Coiegrove et al. | 40/2.2 |
| 3,949,501 | 4/1976 | Andrews et al. | 40/2.2 |

FOREIGN PATENT DOCUMENTS

| | | | |
|---|---|---|---|
| 968487 | 9/1964 | United Kingdom | 40/621 |

*Primary Examiner*—Robert Peshock
*Assistant Examiner*—Wenceslao J. Contreras
*Attorney, Agent, or Firm*—Hill, Van Santen, Steadman, Chiara & Simpson

[57] ABSTRACT

A self-adhering badge assembly comprises a pair of separable substantially flat badge panels adapted to be placed in face-to-face clamping assembly alignment with a selected area of an article of clothing clamped between the panels and thereby supporting the badge assembly in place on the article of clothing. Each of the panels has a similar substantially flat core comprising magnetic material, such as magnetic tape providing N and S poles at opposite sides of the panel, with the poles of one of the panels in complementary orientation relative to the poles of the other of the panels. The core of each of the panels may be enclosed in a respective laminated plastic film jacket. The outer face of the outer panel has indicia display means. The core of each panel may comprise a laminate of the magnetic material and a rigid ferromagnetic core plate.

12 Claims, 5 Drawing Figures

MAGNETIC BADGE ASSEMBLY

This invention relates to indicia displaying badges and is more particularly concerned with a new and improved self-adhering badge assembly.

Various types of badges are known, such as sew-on types, pressure sensitive stick-on types, pocket insert types, pocket lip supported types, pin-on types, by way of example. All such badges have limitations which render them undesirable or unacceptable under various conditions and thus limit their range of usefulness. For instance, the sew-on types of badges presume permanent attachment to a single garment. The stick-on, i.e. pressure sensitive backed, badges have only a single use, temporary utility and have the disadvantage of often becoming easily detached, especially from certain types of garment fabrics. The pocket carried types of badges which have a depending portion engaged in a pocket have the limitation that the garment must have a pocket in order to permit use of that type of badge. As to the pocket lip carried types of badges, again, the garment must have a pocket or equivalent upstanding edge means to support the badge.

Probably the most popular form of prior badge has been the type equipped with a safety pin type mounting means which requires that the pin be secured through the fabric for retaining the badge in position on a garment. Such pin attached badges have the serious disadvantage that some fabrics, especially shirt fabrics and women's blouse fabrics may be and often are damaged by pin penetration and tendency to tear the fabric, sometimes from the mere weight of the badge and frequently from tension that may be exerted on the badge by catching on some object or even brushing thereagainst by the wearer's arm or sleeve.

It is, therefore, apparent that there is need for a badge that will overcome and avoid the disadvantages, drawbacks, undesirable characteristics, shortcomings and problems inherent in prior badges, and it is to that end that the present invention is directed.

Accordingly, it is an important object of the present invention to provide a new and improved badge assembly, which is self-adhering to a selected area of an article of clothing, avoids damaging the article of clothing, is easy to apply and remove as desired, is indefinitely reusable, maintains its fresh and attractive appearance over an extended useful life span, is of low cost, affords a substantial versatility for various badge requirements.

Within the principles of the invention, there is provided a self-adhering badge assembly comprising a pair of separable substantially flat badge panels adapted to be placed in face-to-face clamping assembly alignment with a selected area of an article of clothing clamped between the panels and thereby supporting the badge assembly in place on the article of clothing. Each of said panels has a similar substantially flat core or magnetic material providing a least one N-pole at one side of the panel and at least one S-pole at the opposite side of the panel and preferably alternating polarity at each side. The poles of one of said panels is adapted to be in complementary orientation relative to the poles of the other of said panels in clamping assembly to attain efficient magnetic attraction of each panel for the other panel. The core of each of the panels may be enclosed in a respective laminated plastic film jacket. One of said panels is adapted to lie in exposed relation at the outer side of the clamped area of the article of clothing and has an outer face provided with means for displaying badge indicia.

Other objects, features and advantages of the invention will be readily apparent from the following description of a certain representative embodiment thereof, taken in conjuction with the accompanying drawing although variations and modifications may be effected without departing from the spirit and scope of the novel concepts embodied in the disclosure and in which.

Figure 1:
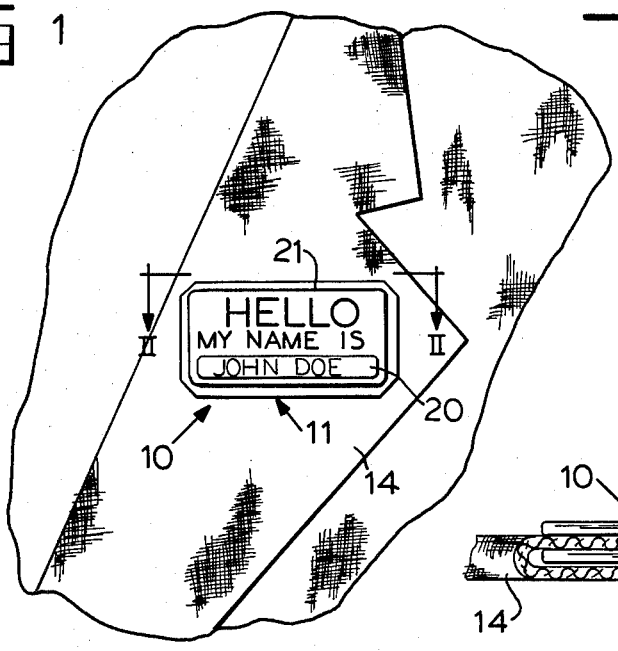
FIG. 1 is a fragmentary elevational view showing a badge embodying the invention applied to a representative garment.
Figure 2:
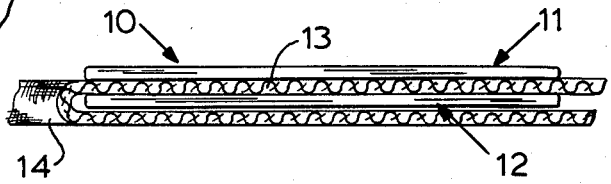
FIG. 2 is an enlarged sectional detail view taken substantially along the line II—II of FIG. 1.

A badge assembly 10 embodying the present invention comprises a pair of separable substantially flat badge panels, namely, an outer panel 11 and an inner panel 12 adapted to be placed in face-to-face clamping assembly alignment (FIGS. 1 and 2) with a selected area 13 of an article of clothing 14 clamped between the panels and thereby supporting the badge in assembly on the article of clothing. By way of example, the badge 10 is shown as applied to the lapel of a jacket, although it should be understood that this is only representative and that the badge may be applied to the selected area of any article of clothing such as a shirt, blouse, coat front, pocket front, trouser, slacks, and the like, whether fabric or generally monolithic plastic, leather, and the like.

Figure 5:
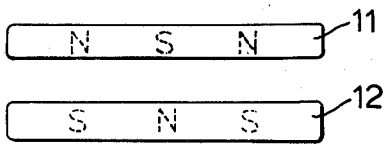
FIG. 5 is a schematic side edge elevational view of the badge panels demonstrating magnetic pole orientation.
Figure 3:
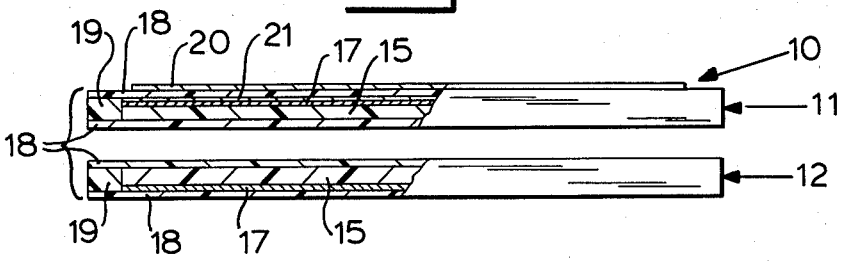
FIG. 3 is an enlarged edgewise assembly view of the badge assembly, partially in section to reveal details of structure.
Figure 4:
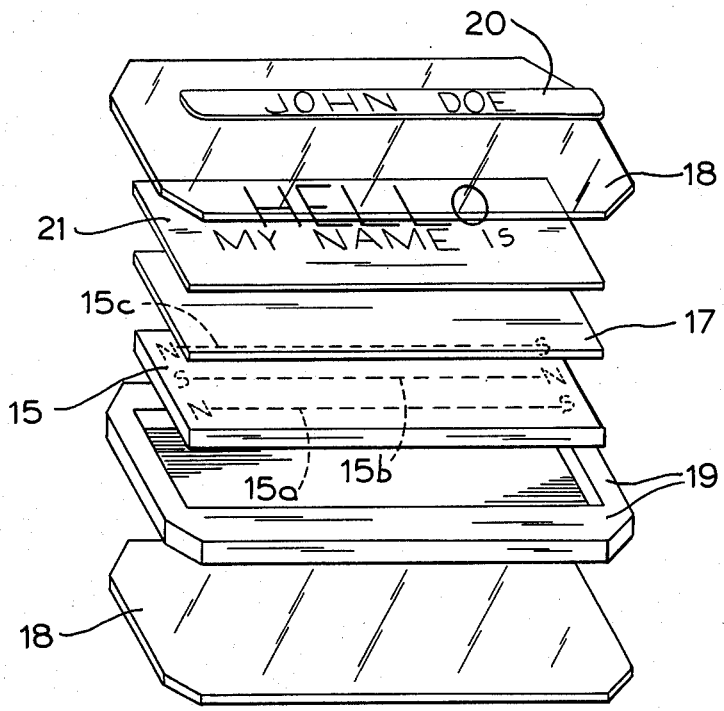
FIG 4 is an exploded assembly view of one of the badge panels.

Each of the panels 11 and 12 is desirably constructed substantially the same as to its basic structure. Accordingly, each of the panels has a similar substantially flat core 15 (FIGS. 3 and 4) of magnetic material providing at least one N-pole at one side of the panel and at least one S-pole at the opposite side of the panel and with the poles of one of the panels in complementary orientation relative to the poles of the other of the panels as schematically indicated in FIG. 5, to attain efficient magnetic attraction of each panel for the other panel in clamping assembly.

Although each of the cores 15 may have one N-pole and one S-pole, in a preferred construction, each of the cores 15 comprises magnetic tape in a preferably one piece having alternating N and S stripes of polarity so that the N-S polarity of one stripe or elongate area of the core plate runs in one direction whereas the next adjacent alternating strip area runs in the opposite direction. Thereby, the badge panel has alternating N-S poles at one side and corresponding alternating S-N poles at the opposite side. The magnetic tape is commercially available in narrow strips so that the core 15 may be built up of a plurality of strips lying side by side. On the other hand, such magnetic tape is also available having alternating N-S stripe areas embodied therein, as schematically indicated at 15*a*, 15*b* and 15*c* in FIG. 4. Such material is preferred for ease of handling and fabrication of the badge panels. The magnetic tape material comprises relatively flexible plastic strip which is magnetically charged as is wellknown, and is supplied in strips or rolls adapted to be cut to desired dimensions. This affords the feasibility of constructing the badge assembly 10 in various sizes for different preferences and requirements. For example, magnetic tape of about 3/64 inch thickness having two to three parallel magnetic stripes of about $\frac{5}{8}$ inch width has been found to be satisfactory for most of the popular sizes of badges.

In order to stiffen the badge panels 11 and 12, a thin metal plate 17 of desirable ferromagnetic material is laminated with the magnetic material in the core of the badge panel. The metal plate 17 should be of as thin gauge as practicable to minimize weight, while nevertheless affording the desired stiffness in the badge panel and while retaining at least some resilient flexibility in the panel. A desirable synergistic effect has been observed in such a magnetic tape and metal plate laminate in that the magnetic fields appear to be enhanced so that when the badge panels 11 and 12 are placed back to back with the magnetic poles in complementary orientation and with the magnetic strips 15 facing one another, there is an exceedingly strong, efficient magnetic attraction which results in a very firm clamping action on the interposed garment area 13 holding the badge against displacement until deliberately removed by forceful separation of the badge panels.

The core of each of the panels 11 and 12 is enclosed in a respective laminated plastic film jacket comprising in each instance a pair of suitable thermofusible plastic sheet material sections 18 of similar size and assembled in laminar relation with the core 15, 17 and thermally secured together by fusion. For this purpose, the thermoplastic sheet sections 18 are dimensioned all around to project beyond the edges of the core laminate 15, 17. For neatness, thermoplastic filler strips 19 approximating the thickness of the core 15, 17, are desirably disposed in a manner of a frame about the edges of the core 15, 17 and between the projecting thermofused margins of the plastic film jacket sections 18. The laminated plastic film jacket provides a smooth, wear-resistant cover for each of the badge panels, besides maintaining each of the panel structure in a unitary assembly.

Means are desirably provided at the outer face of the outer badge panel 11 for displaying indicia. While such indicia displaying means may comprise a sheet 20 of suitable material such as paper, indicia carrying plastic film, or the like, applied to the outer face of the panel 11, it may comprise an indicia carrying sheet 21 such as paper or plastic sheet imprinted with the desired indicia and laminated within the plastic jacket of the panel where the displayed material is to be permanently carried by the badge. For some purposes, it may be desirable to have the badge panel 11 equipped with both forms of indicia displaying means, that is the internally carried sheet 21 and the externally sheet 20, wherein part of the desired indicia display is permanently carried by the internal indicia displaying sheet 21, while the external sheet 20 may be of a smaller dimension as shown and occupy an area on the outer face of the panel 11 which will expose a substantial indicia carrying area of the inner indicia sheet 21, and provide on the outer face of the panel indicia which will vary from badge to badge or may be changed from time to time on the same badge, such as where the badge is to serve as a reusable name badge to be worn by different individuals from time to time. In such instance, the outer indicia displaying sheet 20 may be equipped with pressure sensitive adhesive so that it can be applied as desired and stripped off when no longer needed.

Although each of the badge panels 11 and 12 may carry indicia displaying means, so that the badge would be reversible, in general, only the outer panel 11 need be so equipped because the inner panel 12 will generally be hidden from view while only the outer panel 11 will be in a display position on the garment.

For maximum magnetic attraction of the badge panels 11 and 12, the magnetic core material 15 should be at the face of the panel that is to be placed in opposition to the face of the companion panel. That is, on the outer panel 11, the magnetic core material 15 should be adjacent to the inner face while on the inner panel 12, the core material should be at the outer face, that is the face which will oppose the panel 11, with the metal plates 17 located on the faces of the magnetic core elements 15 which are remote from one another. Exceedingly effective clamping gripping magnetic attraction of the panels 11 and 12 is thus assured when the panels are brought into face-to-face alignment with one another and with the N-S poles in complementary relation. It has been found that when the badge 10 is applied in clamping position with a selected article of clothing area 13, the badge strongly resists displacement unless the panels 11 and 12 are deliberately separated to shift or remove the badge.

At least the outer face plastic jacket sheet 18 should be a clear transparent plastic where the internal indicia displaying sheet 21 is embodied in the badge panel 11.

It will be understood that variations and modifications may be effected without departing from the spirit and scope of the novel concepts of this invention.

I claim as my invention:

1. A self-adhering badge assembly, comprising:

a pair of separable substantially flat badge panels adapted to be placed in face-to-face clamping assembly alignment with a selected area of an article of clothing clamped between the panels and thereby supporting the badge assembly in place on the article of clothing;

each of said panels having a similar substantially flat core comprising magnetic material providing alternating polarity at each of opposite side edge portions of the panel;

the poles of one of said panels being in complementary orientation relative to the poles of the other of said panels in the clamping assembly and attaining efficient magnetic attraction of each panel for the other panel;

and one of said panels being adapted to lie in exposed relation at the outer side of said area of the article of clothing and having an outer face provided with means for displaying badge indicia.

2. A badge assembly according to claim 1 wherein said flat core of magnetic material comprises magnetic tape.

3. A badge assembly according to claim 1, wherein said magnetic core material has on each of the badge panels a plurality of alternating N-S pole stripes with the poles reversed in each adjacent stripe.

4. A badge assembly according to claim 1, wherein said means for displaying badge indicia comprises an indicia carrying sheet laminated between said core plate and a transparent plastic film cover on said outer face of said outer of said one panels.

5. A badge assembly according to claim 1, wherein said means for displaying badge indicia comprises indicia carrying sheet means on the outer face of said one panel.

6. A badge assembly according to claim 1, comprising a respective substantially rigid ferromagnetic core plate in laminar relation to said layer of magnetic core material of each of said panels and providing a stiffening and magnetic flux enhancing part of the core, means securing said laminar layer and plate of each of said panels in unitary relation in the panel, said magnetic material core layers being located at faces of said badge panels which are adapted to face toward one another in the badge assembly, and said plates of said cores being located at the faces of the panels which are adapted to face away from each other in the assembly, said location of said plates assuring that the enhanced magnetic flux will cause enhanced clamping cooperation of the panels on said selected area of said article of clothing.

7. A badge assembly according to claim 1, wherein the core of each of said panels is enclosed in a respective plastic film jacket.

8. A badge assembly according to claim 7, wherein said plastic film jacket comprises respective plastic film sections on each face of each of the panels, said plastic film sections having margins projecting beyond the edge of said flat core, and filler material about the edges of the core and between said margins, said margins and said filler material being secured fixedly together.

9. A badge assembly according to claim 7, wherein said means for displaying badge indicia comprises indicia carrying means laminated within the plastic film jacket which is transparent and also indicia carrying means mounted on the outer face of the jacket of said one panel.

10. A self-adhering badge assembly, comprising:

a pair of separable substantially flat badge panels adapted to be placed in face-to-face clamping assembly alignment with a selected area of an article of clothing clamped between the panels and thereby supporting the badge assembly in place on the article of clothing;

each of said panels having a similar substantially flat core comprising a layer of magnetic material providing at least one N-pole alternating polarity at each of opposite sides of the panel, and with the poles of one of said panels in complementary orientation relative to the poles of the other of said panels to attain efficient magnetic attraction of each panel for the other panel in clamping assembly;

a respective laminated plastic film jacket enclosing said core of each of the panels;

said laminated plastic film jacket of each panel comprising respective plastic film sections on each face of each of the panels;

margins of said plastic film sections projecting beyond the edges of said flat core;

and a frame of filler material about the edges of the core and between said margins;

said margins and said filler material frame being secured fixedly together;

and one of said panels being adapted to lie in exposed relation at the outer side of said area of the article of clothing and having an outer face provided with means for displaying badge indicia.

11. A self-adhering badge assembly, comprising:

a pair of separable substantially flat badge panels adapted to be placed in face-to-face clamping assembly alignment with a selected area of an article of clothing clamped between the panels and thereby supporting the badge assembly in place on the article of clothing;

each of said panels having a similar substantially flat core comprising magnetic material providing alternating polarity at each of opposite sides of the panel;

the poles of one of said panels being in complementary orientation relative to the poles of the other of said panels in the clamping assembly and attaining efficient magnetic attraction of each panel for the other panel;

a respective laminated plastic film jacket enclosing said core of each of the panels;

said core of each of said panels comprising magnetic tape and said magnetic tape being located adjacent to that face of each of the panels which is adapted to face toward the other panel in the clamping assembly;

a thin stiffening ferromagnetic plate in laminar relation in the core with the magnetic tape and laminated at the face of the magnetic tape which is adapted to be adjacent to the outer face of each of the panels in the clamping assembly;

said plastic film jacket of each panel comprising film sections having margins projecting beyond all edges of said core;

filler means between said margins and about the laminar core;

said filler means and said margins being permanently secured together;

and one of said panels being adapted to lie in exposed relation at the outer side of said area of the article of clothing and having an outer face provided with means for displaying badge indicia.

12. A badge assembly according to claim 11, wherein said means for displaying badge indicia comprises an indicia carrying sheet mounted in display position at said outer face of said one panel.

* * * * *

UNITED STATES PATENT AND TRADEMARK OFFICE

CERTIFICATE OF CORRECTION

PATENT NO. : 4,236,331

DATED : December 2, 1980

INVENTOR(S) : Ralph W. Mattson

It is certified that error appears in the above-identified patent and that said Letters Patent are hereby corrected as shown below:

Column 5, line 24, for "edge" read --edges--.

Column 5, line 43, delete --at least one N-pole--.

Signed and Sealed this

*Nineteenth* Day of *January 1982*

[SEAL]

*Attest:*

GERALD J. MOSSINGHOFF

*Attesting Officer*

*Commissioner of Patents and Trademarks*